US005542664A

United States Patent [19]

Mahaffey et al.

[11] Patent Number: 5,542,664

[45] Date of Patent: Aug. 6, 1996

[54] DUAL ADHESIVE ASSEMBLY SYSTEM FOR GOLF CLUBS

[75] Inventors: Steve Mahaffey, Hampden; Rene Rivest, South Hadley, both of Mass.

[73] Assignee: Lisco, Inc., Tampa, Fla.

[21] Appl. No.: 372,657

[22] Filed: Jan. 13, 1995

[51] Int. Cl.[6] ..... A63B 53/02

[52] U.S. Cl. ..... 473/305

[58] Field of Search ..... 273/80 R, 80.2, 273/80.3, 80.4, 80.5, 80.6, 80.7, 80.8, 80.9, 80 C, 167 K

[56] References Cited

U.S. PATENT DOCUMENTS

| | | | |
|---|---|---|---|
| 3,661,388 | 5/1972 | Leslie | 273/80.2 |
| 3,819,781 | 6/1974 | Kornylak | 264/46 |
| 3,907,446 | 9/1975 | Leslie | 403/268 |
| 3,909,045 | 9/1975 | Meagler | 273/80 R |
| 4,470,600 | 9/1984 | Parente et al. | 273/80 B |
| 4,614,343 | 9/1986 | Radway | 273/186 A |
| 4,648,598 | 3/1987 | Kim | 273/80 R |
| 4,854,583 | 8/1989 | Kobayashi | 273/80.8 |
| 4,958,834 | 9/1990 | Colbert | 273/77 A |
| 5,009,423 | 4/1991 | Okumoto et al. | 273/80.2 |
| 5,181,720 | 1/1993 | Stites, III et al. | 273/80.2 |
| 5,205,553 | 4/1993 | Okumoto et al. | 273/80.8 |
| 5,429,355 | 7/1995 | Schmidt et al. | 273/80.2 |

*Primary Examiner*—V. Millin
*Assistant Examiner*—Steven B. Wong

[57] ABSTRACT

Disclosed herein is a golf club and method for assembling the same. The golf club shaft is adhered in the hosel bore using a dual epoxy system. The first epoxy system has a low viscosity and is mixed with a weighting material. The mixture is poured into the hosel bore such that it settles to the inner and lower end of the bore. The second epoxy system is applied around the inner wall of the bore at the opening and to the tip of the shaft. This second epoxy system has a sufficiently high viscosity to prevent flow of the first epoxy system outward onto the hosel and/or shaft when the shaft is inserted into the bore.

15 Claims, 2 Drawing Sheets

DUAL ADHESIVE ASSEMBLY SYSTEM FOR GOLF CLUBS

BACKGROUND OF THE INVENTION

The present invention relates to golf clubs. More particularly, this invention relates to a golf club which has good adhesion between the shaft and golf club head.

In the assembly of golf clubs having a female-type hosel, it is a common practice to add several grams of a weighting material to the club head in order to meet club weight specifications. The weighting material is typically mixed with a low viscosity liquid adhesive and the mixture is then poured into the bore of the hosel. After the mixture which contains the weighting medium has been inserted, a liquid adhesive, which is the same type of adhesive which was mixed with the weighting material, is applied in the hosel bore and to the end of the golf club shaft which is to be inserted into the hosel bore. The shaft is then inserted in the bore and subsequently the adhesive is cured.

Problems have been encountered with the above-described golf club assembly procedure in that epoxy adhesive tends to leak out of the top of the hosel onto to the outside of the shaft and/or the outside of the hosel after the shaft has been inserted in the bore, during the curing process. This is believed to be due to gravitational pressure as a result of the presence of weighting material and epoxy adhesive which is forced inside the shaft during assembly and which rises to a height within the shaft which is above the upper end of the hosel. It is also thought that leakage of epoxy might be caused by capillary action. While epoxy which leaks immediately after the shaft is placed in the hosel bore can be wiped, it is not convenient to continually wipe the hosel and/or shaft during the curing process, which may take several hours.

SUMMARY OF THE INVENTION

An object of the invention is to provide a golf club which contains a weighting medium in the hosel bore and which has a shaft and a head that are assembled using a dual adhesive system.

Another object of the invention is to provide a convenient method for assembling a golf club shaft and a golf club head.

Yet another object of the invention is to provide a golf club assembly technique in which problems of leaking epoxy are substantially overcome.

A further object of the invention is to provide a leak-free method of golf club assembly which provides for strong adhesion between the shaft and the head of the golf club.

Yet another object of the invention is to provide an economical method of assembling a golf club while providing additional weighting to the golf club head.

Other objects of the invention will in part obvious and in part pointed out more in detail hereinafter.

The invention in a preferred form is a golf club comprising a head, a hosel formed on the head having wall means defining a bore which contains a weighting material carried in a first adhesive and a shaft adhered in the bore with a second adhesive. The second adhesive has a greater viscosity than the first adhesive prior to curing in order that the second adhesive substantially prevents leaking of the first adhesive out of the bore between the wall means and the shaft when and/or after the shaft is placed in the bore. In a particularly preferred form, the shaft is hollow and the weighting material is present both inside a portion of the shaft which is in the bore and inside a portion of the shaft which is adjacent to the bore.

Another preferred form of the invention is a method of adhering a golf club shaft to a golf club head. The method comprises the steps of (a) depositing a first adhesive containing a weighting material into the hosel bore, (b) depositing a second adhesive on at least one of an inner side wall which defines the hosel bore and an end of the golf club shaft to be inserted in the bore, (c) placing the end of the golf club shaft in the hosel bore, and after steps (a)–(c) curing the first and second adhesives. The second adhesive has a viscosity which is sufficiently greater than the viscosity of the first adhesive in order to prevent the first adhesive from flowing out of the hosel bore between the inner side wall defining the hosel bore and the shaft before curing is complete.

The invention accordingly comprises the several steps and the relation of one or more of such steps with respect to each of the others and the article possession the features, properties, and the relation of elements exemplified in the following detailed disclosure.

DETAILED DESCRIPTION OF THE INVENTION

Figure 1A:
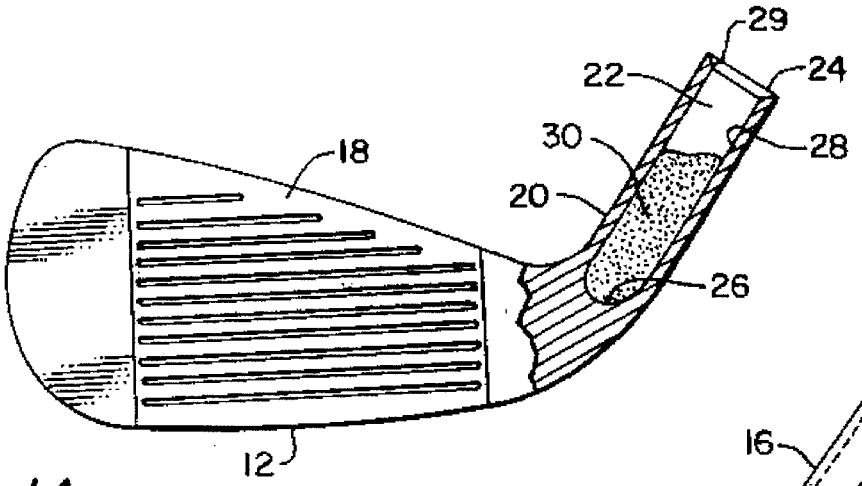
FIGS. 1A–1C show side elevational views, partially cut away, of the head of a golf club iron, showing application of adhesive and insertion of a golf club shaft into the hosel bore.
Figure 1B:
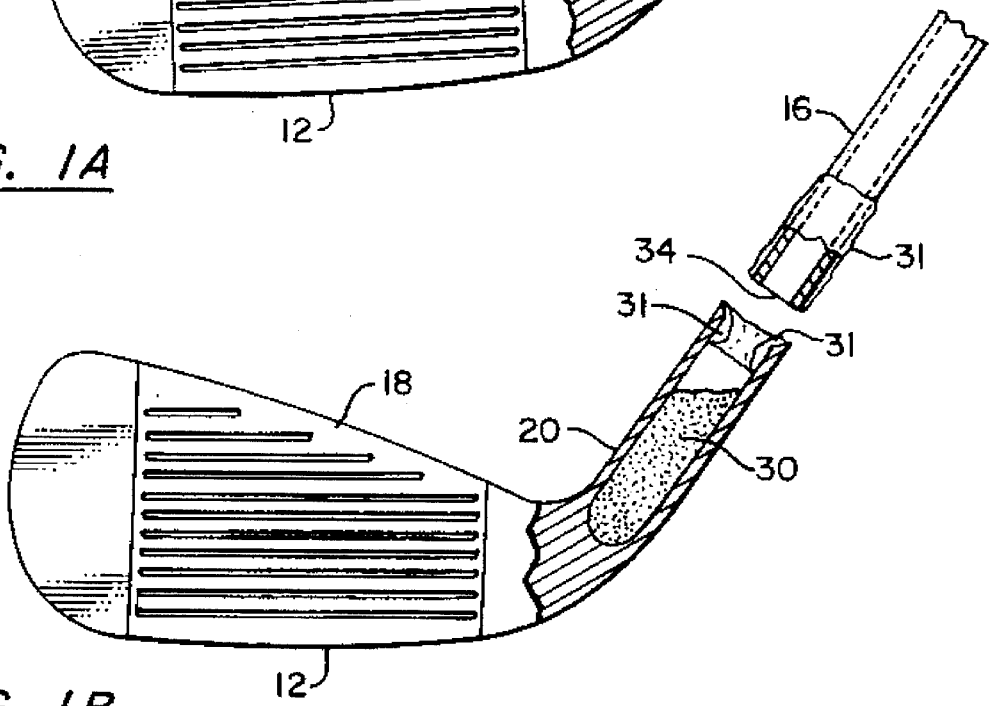
Figure 1C:
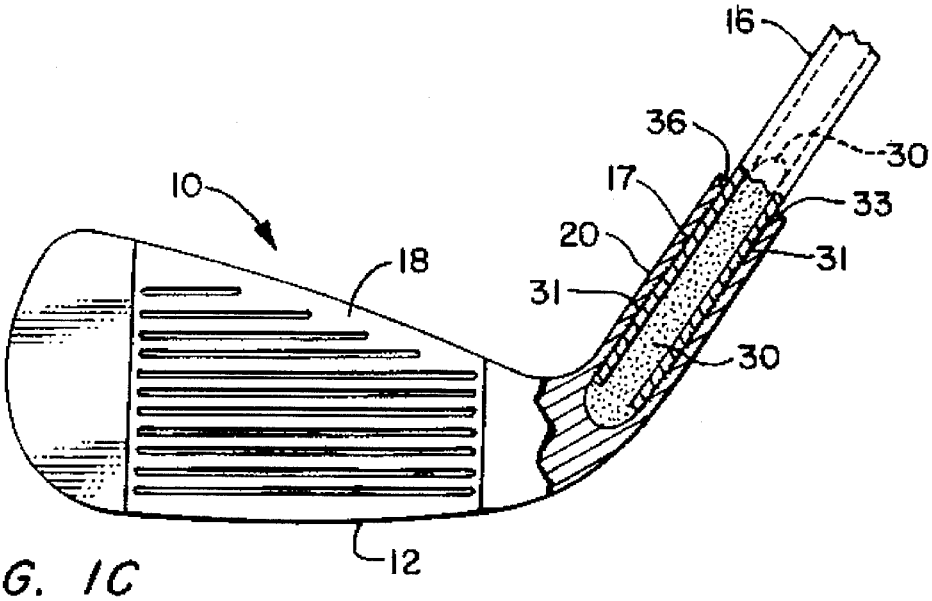

Referring now to the drawings and in particular to FIGS. 1A–1C, the assembly of a golf club 10 in accordance with the present invention is shown. The club 10 includes a head 12 and a hollow shaft 16. The head 12 has a club face 18 and an elongated neck or hosel 20 which has two opposite ends and extends upward at an angle away from the club face 18. The hosel has an elongated cylindrical bore 22 with a round opening 24 at the end of the hosel 20 which is further from the club face 18. The bore 22 is defined by an inner end wall portion 26 opposite to the opening 24, and an intermediate side wall portion 28. When a graphite shaft or the like is used, the portion of the wall adjacent to opening 24 is outwardly bevelled to provide room for sideways bending of the shaft 16 during club use. Thus, as shown in FIGS. 1A–1C, bore 22 is further defined by a frustroconical wall portion 29 adjacent opening 24.

In order to add additional weight to the club head 12, a weighting material such as tungsten powder or the like is mixed with a first adhesive, which is a liquid adhesive such as an epoxy, to form a weighting material—epoxy mixture 30. This mixture, which in the most preferred form has a consistency of similar to cool maple syrup, is poured into the hosel bore and moves downward until it contacts inner end wall 26 of bore 22. The volume of mixture 30 to be used will depend upon the amount of weight to be added in order to meet weight specifications as well as the densities of the weighting material and epoxy. Typically, about ½—6 grams of weighting material—epoxy mixture 30 is added to a golf club iron. While the ratio of epoxy to weighting medium will depend upon the desired weight addition, 1–3 parts by volume epoxy to 1 part by volume weighting material typically is used. A negligible portion of the mixture 30 adheres to the side wall 28 of bore 22 during pouring. The epoxy in mixture 30 preferably has a viscosity of about 5,000–20,000 centipoise (cps) at 25° C.

After mixture 30 has been poured into the hosel bore 22, a second adhesive which is a liquid such as an epoxy 31 having a greater viscosity than the adhesive used in the weighting material—epoxy mixture 30 is deposited in the bore 22 adjacent opening 24. Typically, the epoxy, which in a particularly preferred form has a consistency similar to mayonnaise, is applied in a thickness of about 0.5–4 mm, more preferably 0.5–2 mm, and most preferably 1–1.5 mm and is applied along the frustroconical wall portion 29 and around the circumference of side wall 28 along the portion of side wall 28 which extends from the frustroconical portion 29 inward into the bore for length of, e.g., about 1.5–3.5 cm. The same epoxy is then applied to the end of a shaft 16 which is to be inserted in bore 22. More specifically, epoxy 31 is applied to the terminal end of shaft 16 and along its outer wall 32 from terminal end 34 along the shaft for a distance of about 2.5–3.5 cm.

After pouring the mixture 30 and applying the second epoxy 31 to the walls of bore 22 and to shaft 16, shaft 16 is inserted into bore 22. The shaft slip fits into bore 22 and generally will remain in place in bore 22 as long as no effort is made to remove it. The second epoxy 31 fills the frustroconical annular space 33 between the frustroconical wall portion 29 defining the bore 22 and the outer shaft wall 17.

As shaft 16 is inserted in bore 22, the mixture 30 moves up the inside of hollow shaft 16. As shown in FIG. 1C, a portion of the mixture inside shaft 16, in many cases, will be above the level of the hosel 20. It is believed that gravitational pressure, or another pressure and/or fluid flow principle causes the mixture 30 in the shaft 16 to try to move down to the level of the top of the hosel 20 before and during curing. Ordinarily, this would cause leaking of epoxy at a location designated on FIG. 1C as 36 onto the outer shaft wall 17 or the outside of hosel 20 as a result of upward movement of the epoxy between the shaft 16 and hosel 20. However, because of the high viscosity of second epoxy 31, mixture 30 is not permitted to move down the inside of shaft 16 or up the outside of the portion of the shaft 16 which is in bore 22, and thus no leakage of epoxy 31 occurs during curing. While small amounts of second epoxy 31 and, possibly, mixture 30 may be present on the outside of club 10 immediately after insertion of shaft 16, this material can be wiped off of the club before curing.

In order to adhere the shaft 16 to the hosel 20, the epoxy in mixture 30 and the second epoxy 31 are cured under conditions appropriate to fully cure both types of epoxy. Typically, the required curing conditions constitute the temperature—time combination which is required for the epoxy which is the slower curing of the two epoxies.

The epoxy system which is used in mixture 30 has a sufficiently low viscosity to provide for most of the mixture 30 to form a mass at the lower end of bore 22 when it is first poured, rather than adhering to the higher portions of side wall 28. One epoxy which has been found particularly useful is sold as Epoweld® 3583 and contains Epocure S-6 (Hardman Inc., Belleville, N.J.). This two-part epoxy preferably is mixed in a ratio of 100 parts by weight of part A to 72 parts by weight of part B. The viscosity of part A is about 2,000 cps at 25° C. The viscosity of part B is about 40,000 cps at 25° C. The mixed viscosity, when mixed at 100:72 ratio, is about 15,000 at 25° C. Recommended curing for this epoxy is 12 hours at 25° C. or 2 hours at 66° C.

The second epoxy has a high enough viscosity that it will prevent leakage of the other epoxy outward between the top of the hosel 20 and the shaft 16. An example of an epoxy which can be used as second epoxy 31 is Epoweld® 3650-A, and is available from Hardman Inc. This also contains Epocure S-6, and is a two-part epoxy. This epoxy preferably is mixed at a ratio of 100 parts by weight part A to 82 parts by weight part B. The viscosity of part A is about 250,000 cps at 25° C. The viscosity of Part B is about 35,000–50,000 cps at 25° C. The recommended cure schedule for this epoxy is 24 hours at room temperature, 1 hour at 93° C., 2 hours at 66° C., or 10 minutes at 149° C.

A variety of adhesives, and particularly epoxies, can be used in accordance with the present invention. However, it is important that the adhesive which is mixed with the weighting material have a sufficiently low viscosity that most of mixture 30 will settle to the lower end of bore 22. Furthermore, the second adhesive must have a sufficiently high viscosity before curing that it will prevent the mixture 30 from leaking or flowing outside the hosel between the outer wall 17 of shaft 16 and the walls defining bore 22. In a particularly preferred form of the invention, the epoxy which is mixed with the weighting medium has a viscosity of about 5,000–20,000 at about 25° C. and the viscosity of the second epoxy 31 about 30,000–300,000 at about 25° C.

The weighting medium to be used in accordance with the present invention can be, for example, tungsten powder, lead powder or another type of material which can be conveniently mixed with the epoxy. If only a small amount of additional weight is needed, the first adhesive can serve a dual function, i.e., can serve as both the weighting medium itself and as the material which fixes the weighting medium in the hosel bore. Usually, however, a material having a higher density than the adhesive, such as a metal, is used as the weighting medium.

Figure 2:
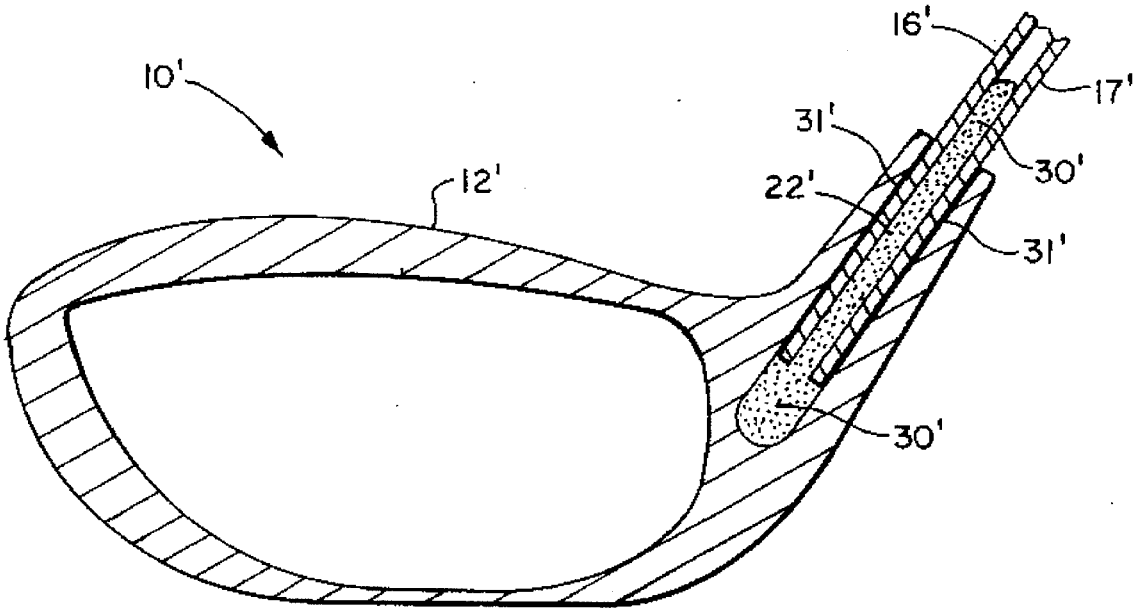
FIG. 2 is a sectional view of a wood-type golf club which was assembled according to the present invention.

FIG. 2 shows a wood type club 10' which contains an epoxy-weighting material 30'. The shaft 16' with outer wall 17' is adhered in hosel bore 22' using a second epoxy 31', which is applied to the shaft and bore in generally the same manner as for the iron in FIGS. 1A–1C. In this embodiment, the upper end wall defining bore 22' is not bevelled and therefore the use of a stiffer shaft 16' is preferred.

Having generally described the invention, the following example is included for purposes of illustration so that the invention may be more readily understood and is in no way intended to limit the scope of the invention unless otherwise specifically indicated.

EXAMPLE

A golf club head made of stainless steel and having a female-type hosel was obtained. A mixture of Epoweld® 2583 with Epocure S-6 was mixed in a ratio of 100 parts by weight part A and 72 parts by weight part B. This mixture was then combined with tungsten powder in amounts of 2 parts by volume epoxy to 1 part by volume weighting material. The resulting mixture was then poured into the bore in the hosel in an amount of about 4.0 g. A graphite golf club shaft was obtained. Epoweld® 3650-A with Epocure S-6 was mixed in a ratio of 100 parts by weight part A and 82 parts by weight part B. This mixture was applied to the outer tip of the shaft at a thickness of about 1.5 mm and both at the end tip of the shaft and along the cylindrical side wall of the shaft for a distance of about 2.8 cm. Epoweld® 3650-A was then applied around the opening of the hosel bore at a thickness of about 1.0 mm and for a length extending from the opening inward into the bore for a distance of about 1.5 cm. The shaft was then inserted in the hosel in order that about 2.8 cm of the shaft was positioned in the hosel bore. The golf club was then cured at 25° C. for about 24 hours. Durability tests revealed that the club would withstand rigorous playing conditions.

What is claimed is:

1. A golf club comprising:

a head, a hosel formed on the head, the hosel having wall means defining a bore containing a weighting material carried in a first adhesive, and a shaft adhered in the hosel bore with a second adhesive, the second adhesive having a greater viscosity than the first adhesive prior to curing in order that the second adhesive substantially prevents leaking of the first adhesive out of the bore between the wall means and the shaft as a result of the shaft being placed in the bore.

2. A golf club according to claim 1, wherein the first adhesive has a viscosity of about 5,000–20,000 cps at about 25° C.

3. A golf club according to claim 1, wherein the second adhesive has a viscosity of about 30,000–300,000 cps at about 25° C.

4. A golf club according to claim 2, wherein the second adhesive has a viscosity of about 30,000–300,000 cps at about 25° C.

5. A golf club according to claim 1, wherein the shaft is hollow and the weighting material is present both inside a portion of the shaft which is in the bore and inside a portion of the shaft which is adjacent to the bore.

6. A golf club according to claim 1, wherein the first adhesive is an epoxy.

7. A golf club according to claim 1, wherein the second adhesive is an epoxy.

8. A golf club according to claim 6, wherein the second adhesive is an epoxy.

9. A method of adhering a golf club shaft to a golf club head having a hosel bore defined by an inner side wall, comprising the steps of:

(a) depositing a first adhesive containing a weighting material into the hosel bore, (b) depositing a second adhesive on at least one of the inner side wall defining the hosel bore and an end of the golf club shaft to be inserted in the bore, (c) after steps (a) and (b), placing the end of the golf club shaft in the hosel bore, and (d) after steps (a)–(c), curing the first and second adhesives, the second adhesive having a viscosity which is sufficiently greater than the viscosity of the first adhesive in order to prevent the first adhesive from flowing out of the hosel bore between the inner side wall defining the hosel bore and the shaft before curing is complete.

10. A method according to claim 9, wherein, in step (b) the second adhesive is deposited on both the inner side wall defining the hosel bore and the end of the shaft to be inserted in the bore.

11. A method according to claim 9, wherein the first adhesive is an epoxy.

12. A method according to claim 11, wherein the second adhesive is an epoxy.

13. A method according to claim 9, wherein the second adhesive is an epoxy.

14. A method according to claim 9, wherein the viscosity of the first adhesive prior to curing is about 5,000–20,000 at about 25° C.

15. A method according to claim 9, wherein the viscosity of the second adhesive prior to curing is about 30,000–300,000 cps at about 25° C.

* * * * *